US010677054B2

(12) United States Patent
Arnold et al.

(10) Patent No.: US 10,677,054 B2
(45) Date of Patent: Jun. 9, 2020

(54) CUTTING BIT ASSEMBLY

(71) Applicants: Joy MM Delaware, Inc., Wilmington, DE (US); Element Six (UK) Limited, Didcot, Oxfordshire (GB); Element Six GmbH, Burghaun (DE)

(72) Inventors: Randy Arnold, Harrisville, PA (US); James E. Folkerts, Centralia, IL (US); John R. Frederick, Allison Park, PA (US); John Hallberg, Mercer, PA (US); James Krellner, Franklin, PA (US); David Meade, Franklin, PA (US); Bulent Tiryaki, Franklin, PA (US); Charles Simon James Pickles, Oxfordshire (GB); Peter Robert Bush, Oxfordshire (GB); Christopher John Howard Wort, Oxfordshire (GB); Serena Bonetti, Oxfordshire (GB); Bernd Heinrich Ries, Hünfeld (DE); Markus Kilian Scharting, Frankfurt (DE)

(73) Assignee: Joy Global Underground Mining LLC, Warrendale, PA (US)

( * ) Notice: Subject to any disclaimer, the term of this patent is extended or adjusted under 35 U.S.C. 154(b) by 0 days.

(21) Appl. No.: 15/749,420

(22) PCT Filed: Jul. 29, 2016

(86) PCT No.: PCT/US2016/044861

§ 371 (c)(1),
(2) Date: Jan. 31, 2018

(87) PCT Pub. No.: WO2017/023804

PCT Pub. Date: Feb. 9, 2017

(65) Prior Publication Data

US 2018/0223661 A1 Aug. 9, 2018

Related U.S. Application Data

(60) Provisional application No. 62/199,495, filed on Jul. 31, 2015.

(51) Int. Cl.
*E21C 35/18* (2006.01)
*E21C 35/197* (2006.01)
(Continued)

(52) U.S. Cl.
CPC ..... *E21C 35/197* (2013.01); *B28D 1/18* (2013.01); *B28D 1/188* (2013.01); *E21C 27/24* (2013.01); *E21C 35/19* (2013.01); *E21C 35/1933* (2013.01)

(58) Field of Classification Search
CPC ..... E21C 35/19; E21C 35/197
(Continued)

(56) References Cited

U.S. PATENT DOCUMENTS 3,752,515 A 8/1973 Oaks et al.
4,337,980 A 7/1982 Krekeler
(Continued)

FOREIGN PATENT DOCUMENTS

AU 2012200519 1/2010
CA 981291 A 1/1976
(Continued)

OTHER PUBLICATIONS

International Search Report and Written Opinion for Application No. PCT/US2016/044861 dated Feb. 15, 2018 (12 pages).
(Continued)

*Primary Examiner* — Janine M Kreck
(74) *Attorney, Agent, or Firm* — Michael Best & Friedrich LLP

(57) ABSTRACT

A cutting bit assembly for a mining machine includes a holder having a first surface, a second surface, and a bore
(Continued)

extending therebetween, and a bit having a first end and a second end. The bit further includes a tip, a shank, and a shoulder positioned between the tip and the shank. The shank is positioned in the bore of the holder and defines a shank axis. The shoulder engages the first surface of the holder. The shank includes a projection adjacent the second end. The cutting bit assembly also includes a retainer having a groove and a resilient member. The groove engages a portion of the projection. The resilient portion engages the second surface of the holder and biases the retainer along the shank axis and away from the holder.

25 Claims, 13 Drawing Sheets

(51) Int. Cl.

| | |
|---|---|
| ***E21C 27/24*** | (2006.01) |
| ***E21C 35/19*** | (2006.01) |
| ***B28D 1/18*** | (2006.01) |
| *E21C 35/193* | (2006.01) |

(58) Field of Classification Search
USPC ..... 411/349, 549, 553, 554, 350
See application file for complete search history.

(56) References Cited

U.S. PATENT DOCUMENTS

| | | | | |
|---|---|---|---|---|
| 4,626,034 | A | 12/1986 | Breuer et al. | |
| 4,632,463 | A | 12/1986 | Sterwerf, Jr. | |
| 4,755,003 | A * | 7/1988 | Pinkerton | E21C 35/197 299/107 |
| 5,007,685 | A | 4/1991 | Beach et al. | |
| 5,018,793 | A * | 5/1991 | Den Besten | E21C 35/197 299/107 |
| 5,318,351 | A | 6/1994 | Walker | |
| 6,364,420 | B1 | 4/2002 | Sollami | |
| 6,427,869 | B1 | 8/2002 | Corbett | |
| 7,343,947 | B1 * | 3/2008 | Sollami | E21C 35/197 144/241 |
| 8,678,516 | B2 | 3/2014 | Fader et al. | |
| 2006/0238016 | A1 * | 10/2006 | Ritchey | E02F 9/2866 299/107 |
| 2006/0261662 | A1 * | 11/2006 | Sollami | E21C 35/197 299/104 |
| 2006/0261663 | A1 | 11/2006 | Sollami | |
| 2007/0081873 | A1 | 4/2007 | Blomstedt et al. | |
| 2008/0284235 | A1 | 11/2008 | Hall et al. | |
| 2009/0261646 | A1 | 10/2009 | Ritchey et al. | |
| 2011/0233987 | A1 | 9/2011 | Maushart | |
| 2012/0068526 | A1 | 3/2012 | Wachsmann et al. | |
| 2013/0181501 | A1 | 7/2013 | Hall et al. | |
| 2015/0130258 | A1 | 5/2015 | Sollami | |

FOREIGN PATENT DOCUMENTS

| | | | |
|---|---|---|---|
| CN | 1204381 | A | 1/1999 |
| CN | 102822424 | A | 12/2012 |
| CN | 102828750 | A | 12/2012 |
| EP | 2845997 | A1 | 3/2015 |
| EP | 2845991 | A1 | 11/2015 |
| GB | 1142141 | A | 2/1969 |
| GB | 2105768 | A | 3/1983 |
| RU | 2132949 | C1 | 7/1999 |
| SU | 875024 | A1 | 10/1981 |
| WO | 2011016765 | | 2/2011 |

OTHER PUBLICATIONS

Office Action issued from the Chinese Patent Office for related Application No. 201680053034.4 dated Jan. 24, 2019 (11 pages including Statement of Relevance).
Search Report issued from the European Patent Office for related Application No. 16833646.9 dated Feb. 22, 2019 (16 pages).
Russian Office action for Application No. 2018107050 dated Nov. 28, 2019 (13 pages).
Extended European Search Report from the European Patent Office for Application No. 16833646.9 dated Jun. 28, 2019 (14 pages).

* cited by examiner

CUTTING BIT ASSEMBLY

REFERENCE TO RELATED APPLICATION

This application claims the benefit of co-pending, prior-filed U.S. Provisional Patent Application No. 62/199,495, filed Jul. 31, 2015, the entire contents of which are hereby incorporated by reference.

BACKGROUND

The present disclosure relates to mining machines, and particularly to a cutting bit assembly for a mining machine.

Conventional continuous mining machines include a cutter head including multiple cutting bit assemblies. In some embodiments, each cutting bit assembly includes a bit removably coupled to a holder block, and the holder block is affixed to a rotating drum. In some embodiments, the bit may be received within a sleeve that is in turn secured within the holder block. In some embodiments, the bit may be rotatable relative to the holder block.

SUMMARY

In one aspect, a cutting bit assembly for a mining machine includes a holder having a first surface, a second surface, and a bore extending therebetween, and a bit having a first end and a second end. The bit further includes a tip proximate the first end, a shank proximate the second end, and a shoulder positioned between the tip and the shank. The shank is positioned in the bore of the holder and defines a shank axis. The shoulder engages the first surface of the holder. The shank includes a projection adjacent the second end. The cutting bit assembly also includes a retainer having a groove and a resilient member. The groove engages a portion of the projection. The resilient portion engages the second surface of the holder and biases the retainer along the shank axis and away from the holder.

In another aspect, a cutting bit assembly for a mining machine includes a holder having a bore, and a sleeve having a first surface, a second surface, and a bore extending therebetween. The sleeve is positioned in the bore of the holder. The cutting bit assembly also includes a bit having a first end and a second end. The bit further includes a tip proximate the first end, a shank proximate the second end, and a shoulder positioned between the tip and the shank. The shank is positioned in the bore of the sleeve. The shank defines a shank axis. The shoulder engages the first surface of the sleeve. The shank includes a projection adjacent the second end. The cutting bit assembly further includes a retainer having a groove and a resilient member. The groove engages a portion of the projection. The resilient member engages the second surface of the sleeve and biases the retainer along the shank axis and away from the sleeve.

In still another aspect, a cutting bit assembly for a mining machine includes a holder having a first surface, a second surface, and a bore extending therebetween, and a bit having a first end and a second end. The bit includes a tip proximate the first end, a shank, and a shoulder. The shank is positioned proximate the second end of the bit and positioned in the bore of the holder. The shoulder is positioned between the shank and the tip and engages the first surface of the holder. The shank includes an internal bore extending from the second end at least partially toward the first end. The cutting bit assembly also includes a retainer having a first portion and a second portion. The first portion is removably coupled to the internal bore of the shank. The second portion engages the rear surface of the holder to secure the bit against movement relative to the holder.

In still yet another aspect, a cutting bit assembly for a mining machine includes a holder having a bore, and a sleeve including a first surface, a second surface, and a bore extending therebetween. The sleeve is positioned in the bore of the holder. The cutting bit assembly also includes a bit having a first end and a second end. The bit includes a tip proximate the first end, a shank, and a shoulder. The shank is positioned proximate the second end of the bit and positioned in the bore of the sleeve. The shoulder is positioned between the shank and the tip and engages the first surface of the sleeve. The shank includes an internal bore extending from the second end at least partially toward the first end. The cutting bit assembly further includes a retainer having a first portion and a second portion. The first portion is removably coupled to the internal bore of the shank. The second portion engages the rear surface of the sleeve to secure the bit against movement relative to the holder.

Other aspects of the invention will become apparent by consideration of the detailed description and accompanying drawings.

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical or hydraulic connections or couplings, whether direct or indirect. Also, electronic communications and notifications may be performed using any known means including direct connections, wireless connections, etc.

DETAILED DESCRIPTION

Figure 1:
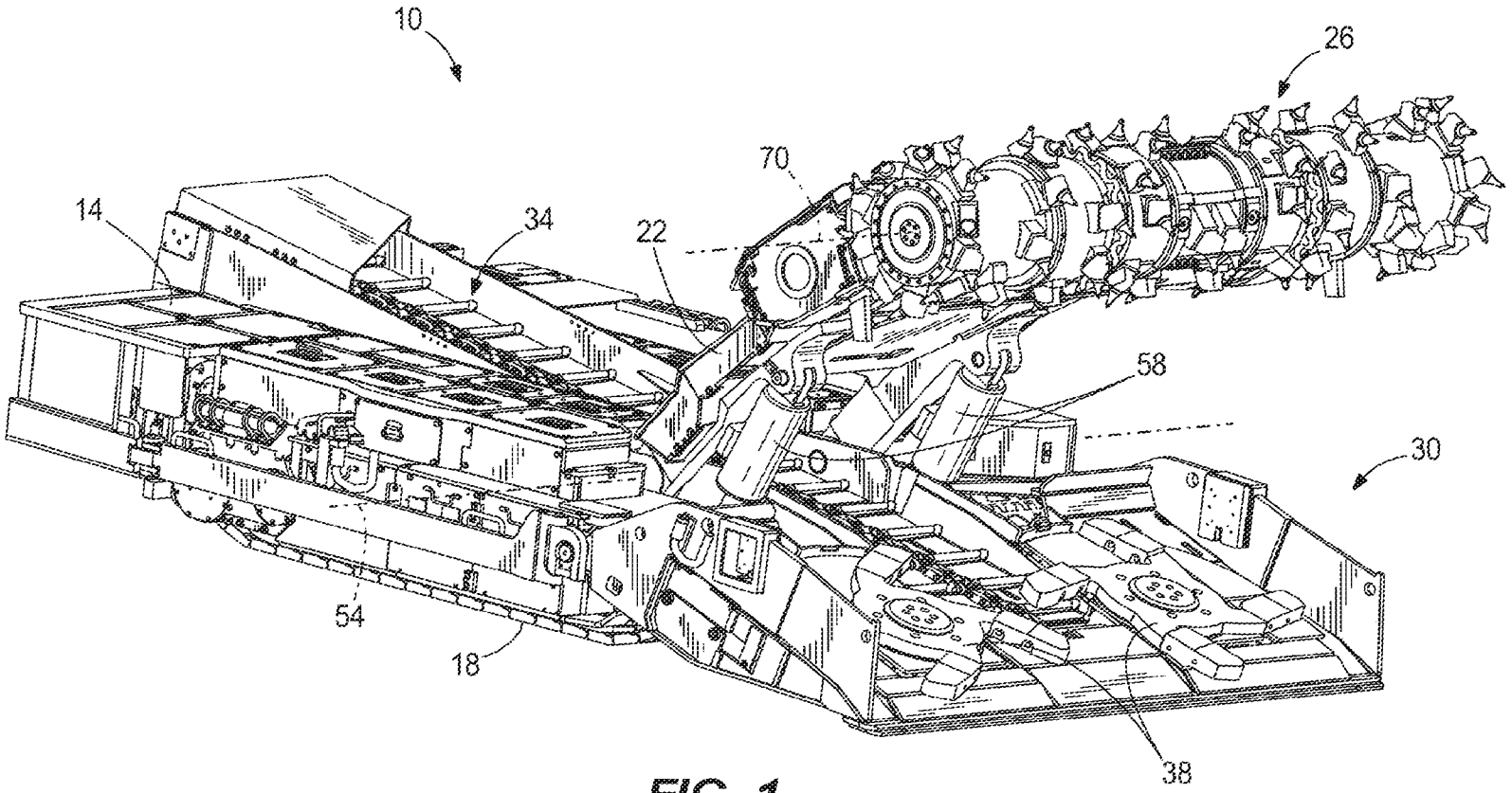
FIG. 1 is a perspective view of a mining machine including a cutter head.

FIG. 1 illustrates a mining machine, such as a continuous miner 10, including a frame 14 that is supported for movement by tracks 18. The continuous miner 10 further includes a boom 22 and a cutter head 26 supported on the boom 22. In the illustrated embodiment, the frame 14 also includes a gathering head 30 and a conveyor 34 extending from a first or front end of the frame 14 toward a second or rear end of the frame 14. The gathering head 30 includes a pair of rotating arms 38 that engage cut material below the cutter head 26 and direct the cut material onto the conveyor 34. The conveyor 34 transports the cut material along a longitudinal axis of the frame 14, from the area below the cutter head 26 to a second conveyor (not shown) positioned proximate the second end of the frame 14.

The boom 22 includes one end pivotably coupled to the frame 14 and another end supporting the cutter head 26. The boom 22 is pivotable about a pivot axis 54 that is generally transverse to the longitudinal axis of the frame 14. The boom 22 is pivoted by a pair of actuators 58 that are coupled between the frame 14 and the boom 22. In the illustrated embodiment, the actuators 58 are hydraulic jacks or cylinders.

Figure 2:
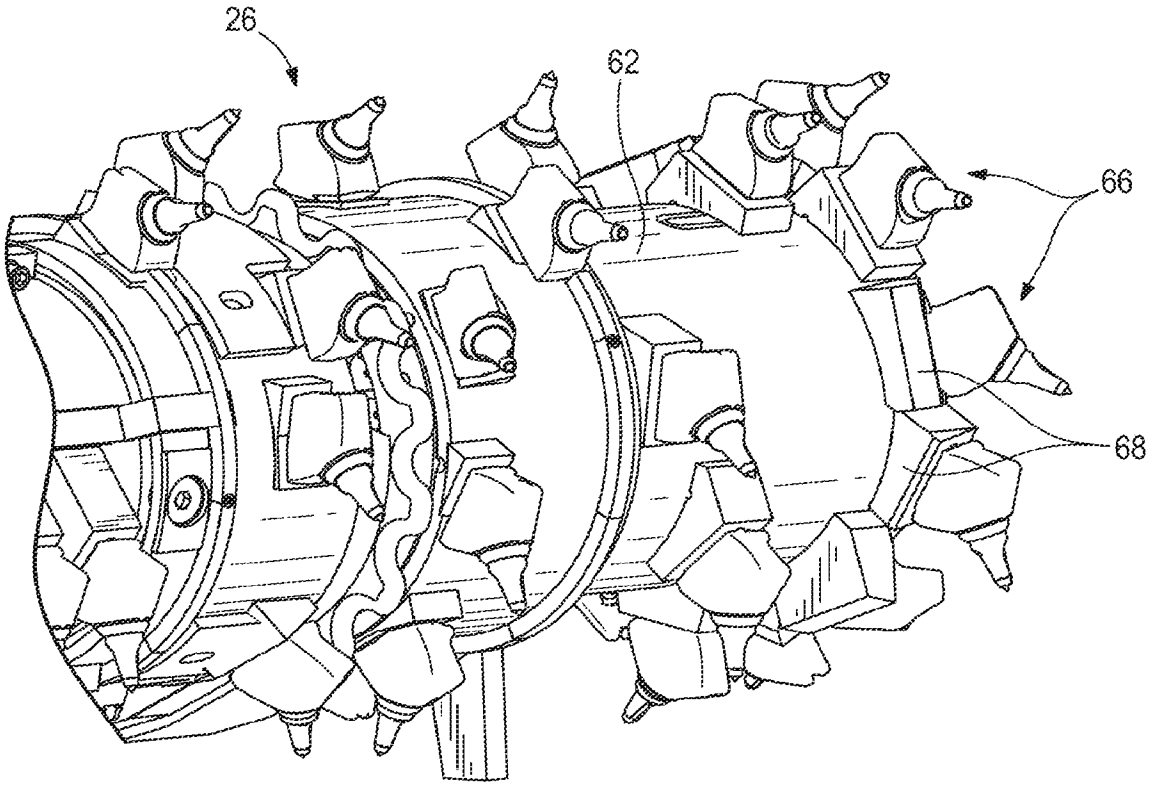
FIG. 2 is a perspective view of a portion of the cutter head of FIG. 1.

As shown in FIG. 2, the cutter head 26 is formed as an elongated drum 62 including cutting bit assemblies 66 secured to an outer surface of the drum 62. In the illustrated embodiment, the outer surface of the drum 62 includes multiple pedestals 68, and each cutter bit assembly 66 is secured to one of the pedestals 68. The drum 62 defines a drum axis 70 (FIG. 1) that is generally parallel to the pivot axis 54 of the boom 22, and the drum 62 is rotatable about the drum axis 70. In other embodiments, the cutting bit assemblies 66 may be directly coupled to the drum 62 by omitting the pedestals 68. In still other embodiments, the cutting bit assembly 66 may be used on another type of cutter head (e.g., a cutter head for a longwall shearer).

Figure 3:
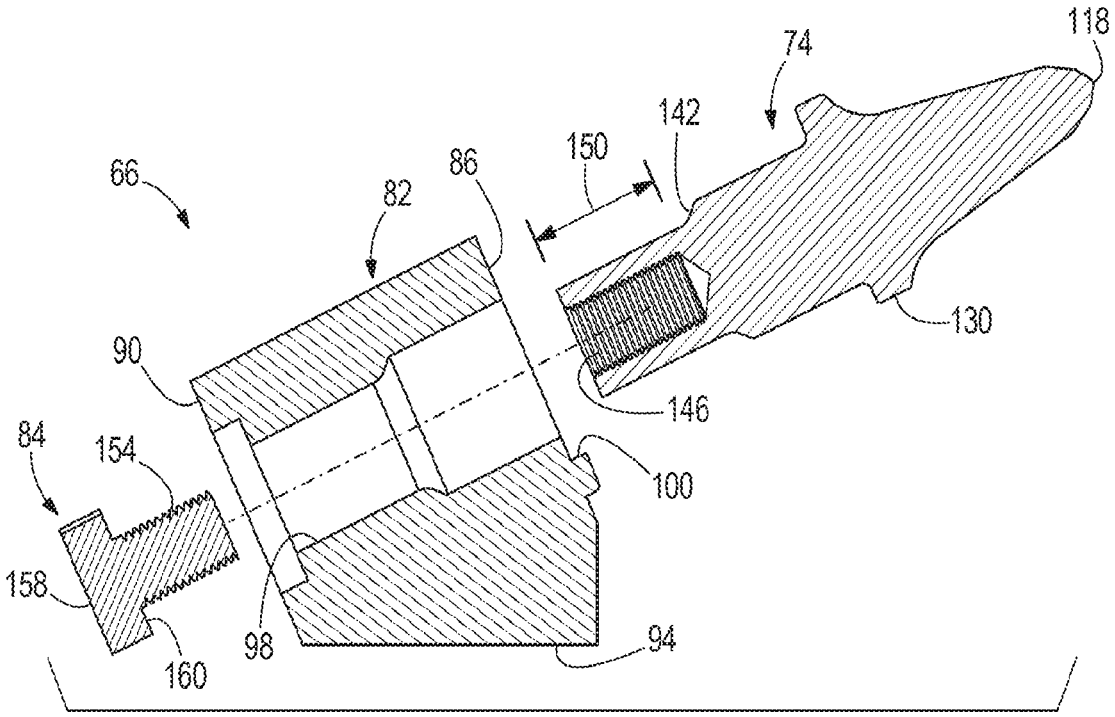
FIG. 3 is an exploded side section view of a cutting bit assembly.

Referring to FIG. 3, each cutting bit assembly 66 includes a bit 74 and a holder block 82. Each bit 74 is secured to a respective holder block 82 by a retainer 84. The holder block 82 defines a first or forward surface 86, a second or rear surface 90, a supporting surface 94, and a slot or bore 98 extending between the forward surface 86 and the rear surface 90. In one embodiment, the supporting surface 94 is affixed to one of the pedestals 68 (FIG. 2).

Figure 4:
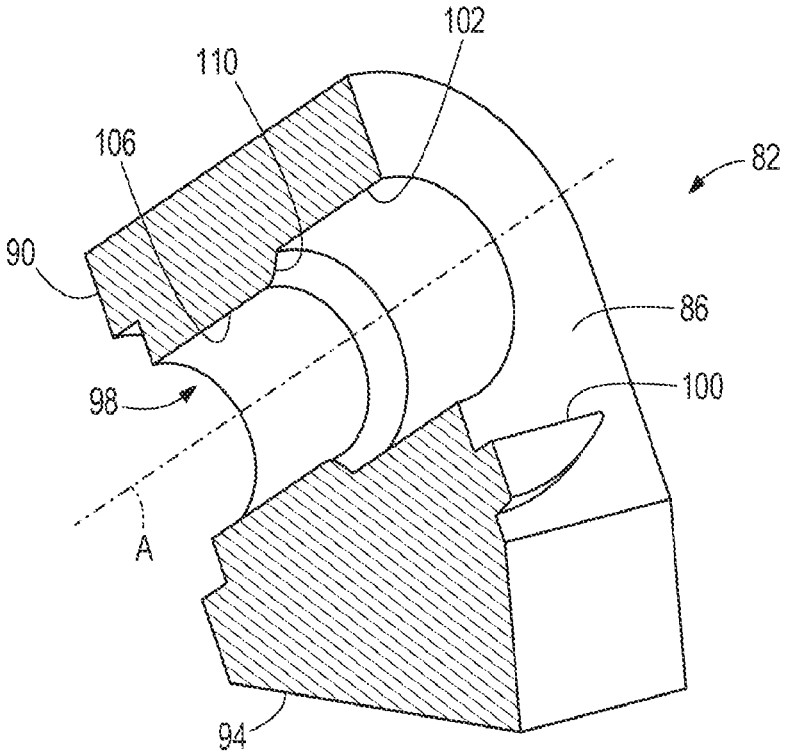
FIG. 4 is a perspective section view of a holder block.

As shown in FIG. 4, a projection or lip 100 is formed on the forward surface 86 of the block 82 and defines a raised portion extending away from the forward surface 86. In the illustrated embodiment, the bore 98 defines a central axis A that is generally perpendicular to the forward and rear surfaces 86, 90. The bore 98 is circular and includes a first portion 102 separated from a second portion 106 by a ledge 110. The first portion 102 includes a larger diameter than the second portion 106. In the illustrated embodiment, the ledge 110 defines an internal tapered portion of the bore 98. In other embodiments, the internal tapered portion may extend over a larger portion of the bore 98, and/or the full length of the bore 98 may have an internal taper. In still other embodiments, the ledge may be formed as a flat annular surface oriented perpendicular to the axis A (i.e., a counter bore).

Figure 5:
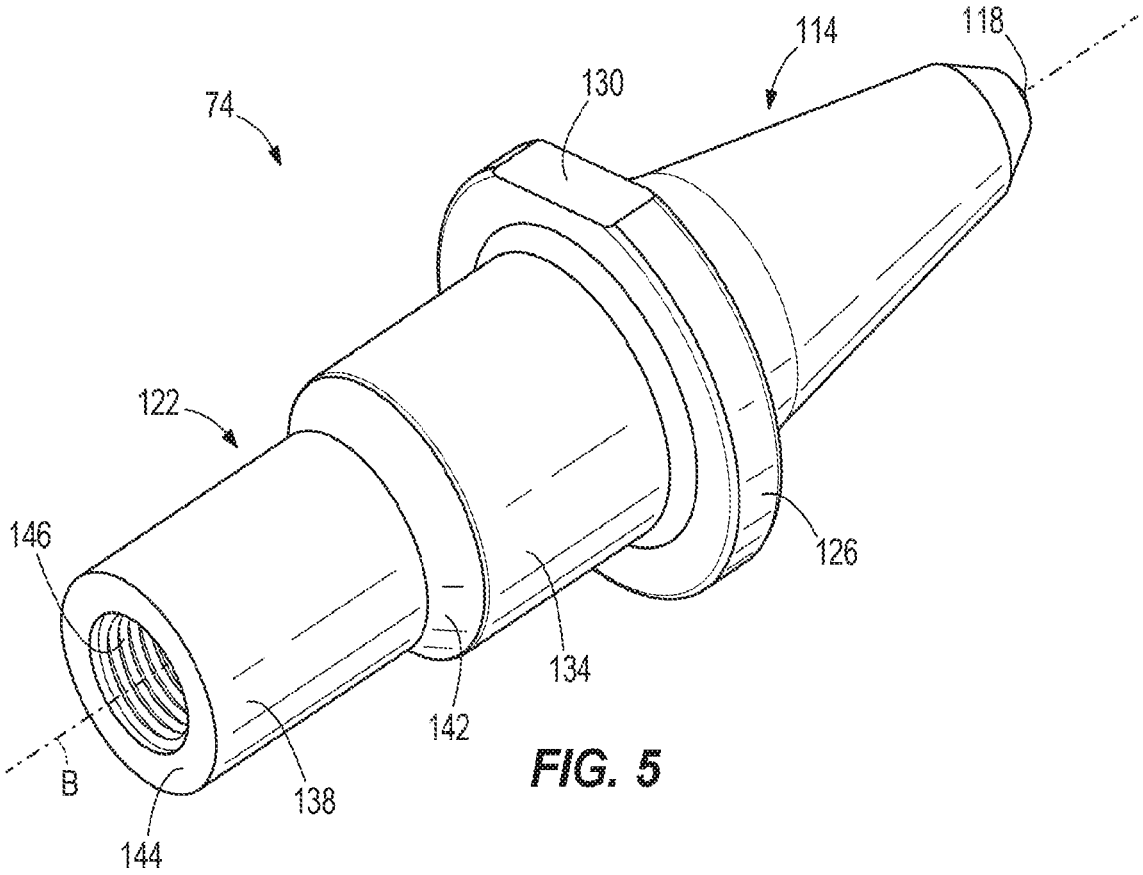
FIG. 5 is a perspective view of a bit.

FIG. 5 illustrates the bit 74 including a first portion 114 having a tip 118 for engaging a mine face to remove material, and an elongated second portion or shank 122. The shank 122 is positioned proximate an end surface 144 of the bit 74, distal with respect to the tip 118. The shank 122 defines a bit axis B. In the illustrated embodiment, the tip 118 is coaxial with (i.e., the tip 118 is positioned on) the bit axis B. The bit 74 further includes a shoulder 126 positioned between the first portion 114 and the shank 122. In the illustrated embodiment, the shoulder 126 has a diameter larger than each of the first portion 114 and the shank 122, and a circumferential or peripheral or outer surface of the shoulder 126 includes a flat surface 130.

The illustrated shank 122 includes a first portion 134 and a second portion 138, with the first portion 134 including a larger diameter than the second portion 138. An external tapered portion 142 extends between the first portion 134 and the second portion 138. The first portion 134, second portion 138 and external tapered portion 142 are sized to abut the first portion 102 of the bore 98, the second portion 106 of the bore 98, and the ledge 110, respectively. In the illustrated embodiment, the shank 122 includes an internal threaded bore 146 extending from the end surface 144 along at least a portion of the bit axis B and having a length 150 (FIG. 3).

Figure 6:
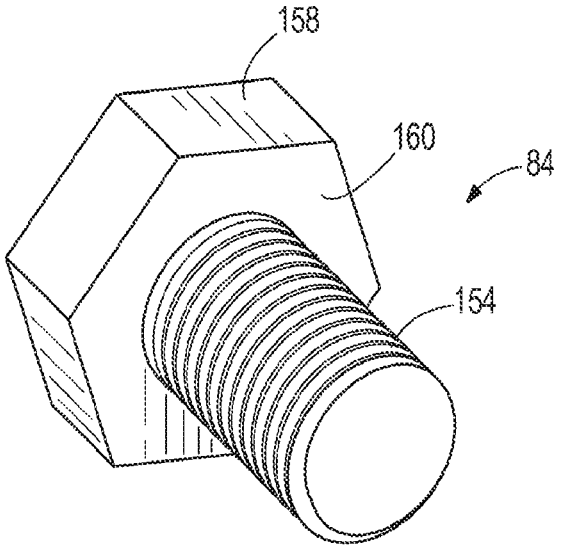
FIG. 6 is a perspective view of a retainer.

As shown in FIG. 6, the retainer 84 includes a fastener having a threaded portion 154 and a hexagonal-shaped head 158. The threaded portion 154 is configured to threadably engage the internal threaded bore 146 of the bit 74. The head 158 defines a retaining surface 160 adjacent an end of the threaded portion 154. The head 158 is sized for a standard socket wrench or the like to rotate the retainer 84 relative to the shank 122. In the illustrated embodiment, the retainer 84 is manufactured from a plastic material; however, in other embodiments, the retainer 84 may be manufactured from a metallic material.

Figure 7:
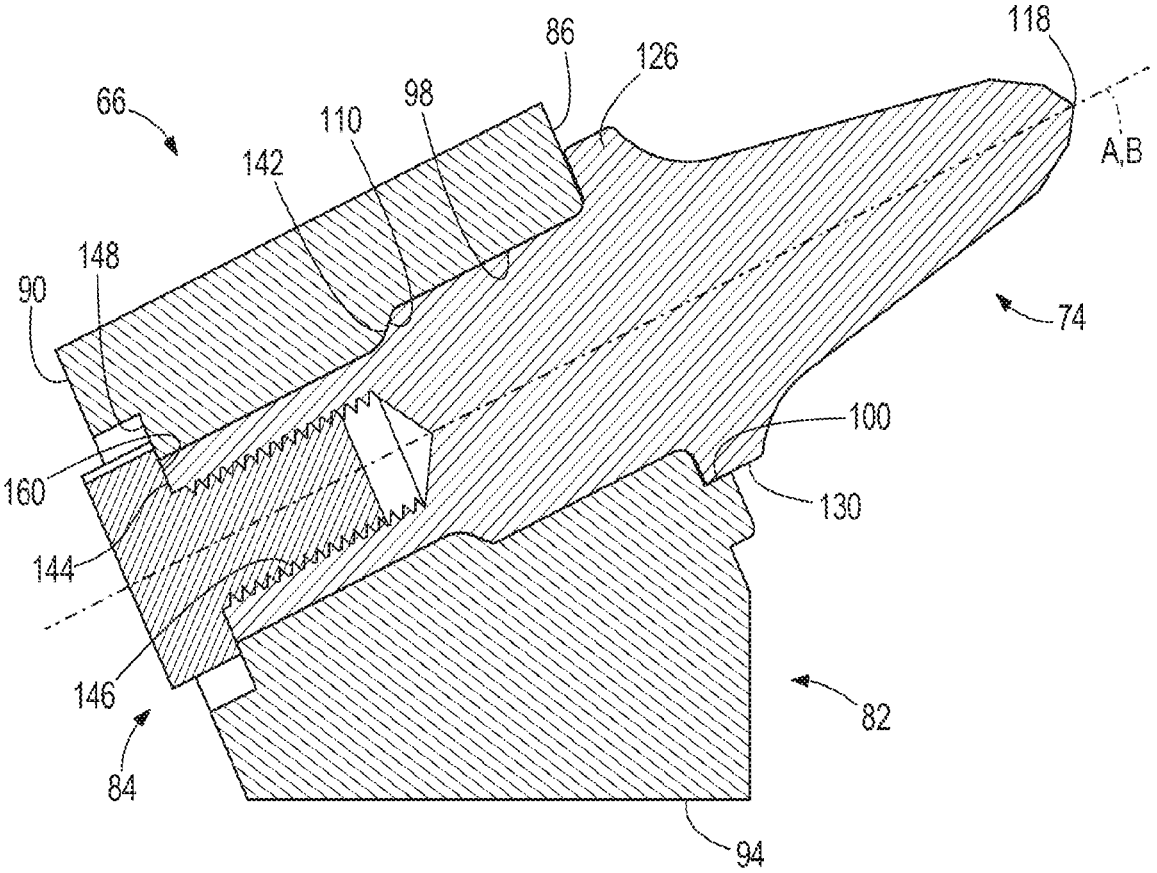
FIG. 7 is a side section view of the cutting bit assembly of FIG. 3 in an assembled state.

As shown in FIG. 7, when the bit 74 is received within the bore 98 of the holder block 82, the external tapered portion 142 abuts the ledge 110 and the bit axis B is aligned with the central axis A of the bore 98. The shoulder 126 of the bit 74 abuts the forward surface 86 of the holder block 82 with the flat surface 130 abutting the lip 100. The engagement between the flat surface 130 and the lip 100 secures the bit 74 against rotational movement relative to the holder block 82.

When the retainer 84 engages the internal threaded bore 146 of the bit 74, the retaining surface 160 is positioned adjacent the rear surface 90 of the holder block 82. In the illustrated embodiment, a counterbore 148 is formed in the rear surface 90 with the retaining surface 160 abutting the counterbore 148 and the end surface 144 of the shank 122 being substantially flush with the counterbore 148. In other embodiments, the rear surface 90 may not include a counterbore, and the retaining surface 160 may directly abut the rear surface 90 and the end surface 144 may be substantially flush or coextensive with the rear surface 90 of the holder block 82. In other embodiments, the end surface 144 may be recessed from the counterbore 148 (or the rear surface 90) such that the retaining surface 160 of the retainer 84 only abuts the counterbore 148 (or the rear surface 90) of the holder block 82.

The retainer 84 provides a mechanism for quickly securing and releasing each bit 74 with respect to the holder block 82. During operation of the continuous miner 10, bits 74 may be damaged or worn as the cutter head 26 is rotated and the bits 74 engage the mine face. A retainer 84 can be quickly removed from a damaged or worn bit 74 to remove the damaged or worn bit 74 from the holder block 82. A replacement bit 74 is then positioned within the holder block 82 and the retainer 84 is threadably inserted into the bore 146 of the replacement bit 74 to secure the replacement bit 74 to the holder block 82.

FIGS. 8-11 illustrate a cutting bit assembly 266 according to another embodiment. The cutting bit assembly 266 is similar to the cutting bit assembly 66; therefore, similar components have been given similar reference numbers, plus 200. Only differences between the cutting bit assemblies 66, 266 will be discussed in detail. In addition, components or features described with respect to only one or some of the embodiments described herein are equally applicable to any other embodiments described herein.

Figure 8:
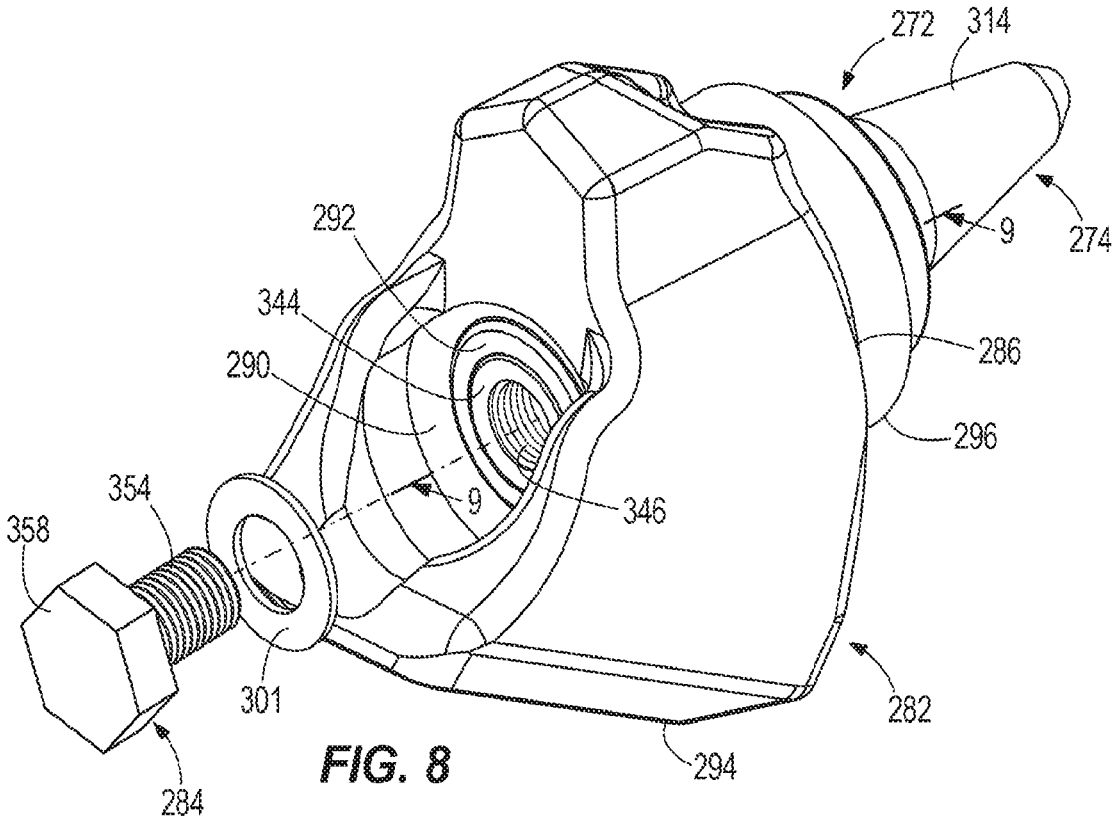
FIG. 8 is a partially exploded perspective view of a cutting bit assembly according to another embodiment.

Referring to FIG. 8, each cutting bit assembly 266 includes a bit 274, a sleeve 272, and a holder block 282. Each bit 274 is secured to a respective holder block 282 by a retainer 284. As shown in FIGS. 8 and 10, the holder block 282 defines a first or forward surface 286, a second or rear surface 290, a supporting surface 294, and a bore 295 (FIG. 9) extending between the forward surface 286 and the rear surface 290.

Figure 9:
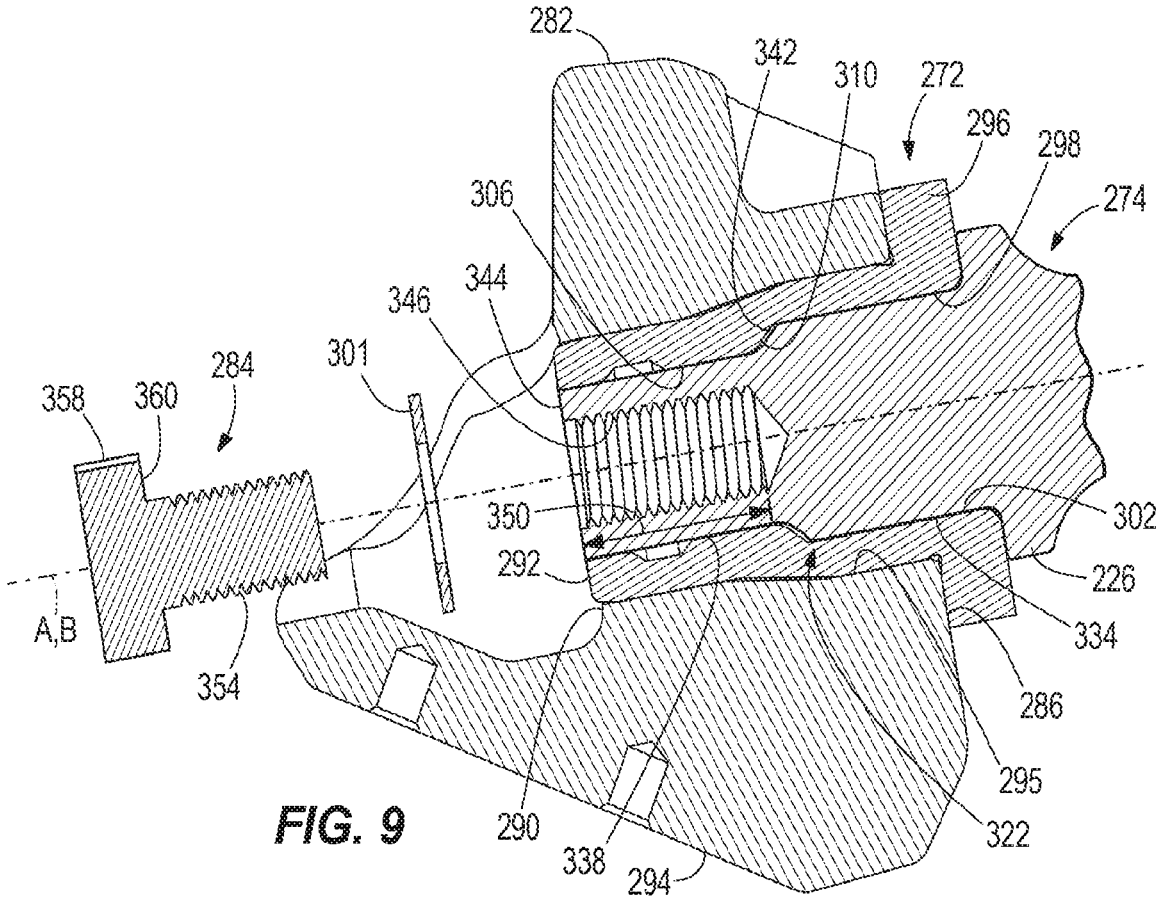
FIG. 9 is a section view of a portion of the cutting bit assembly of FIG. 8 viewed along section 9-9.
Figure 10:
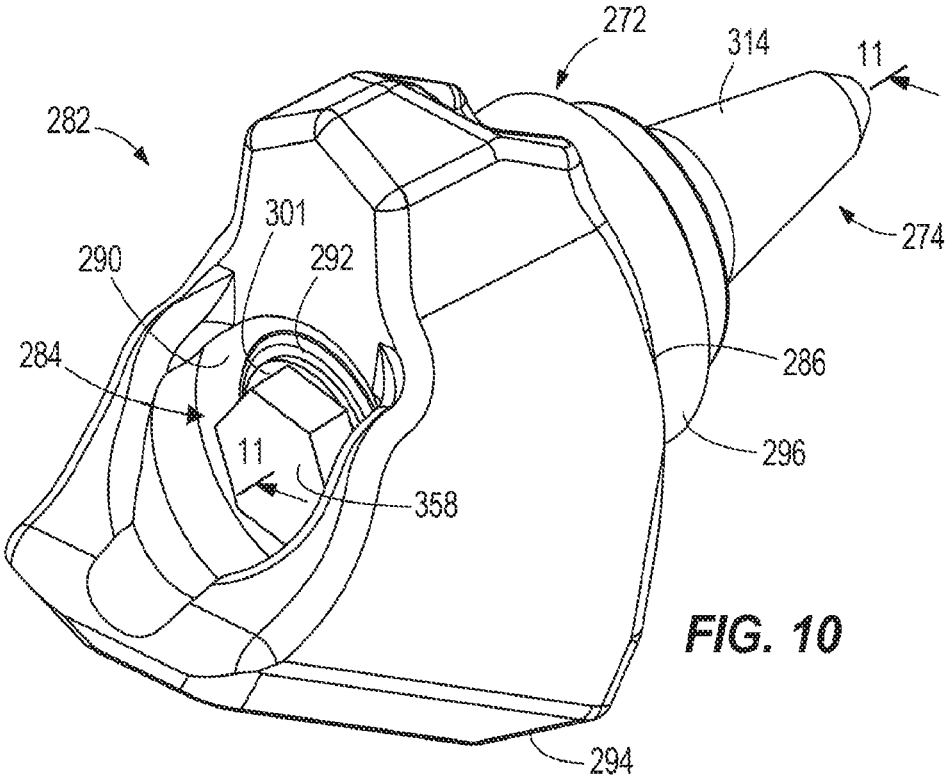
FIG. 10 is a perspective view of the cutting bit assembly of FIG. 8 in an assembled state.
Figure 11:
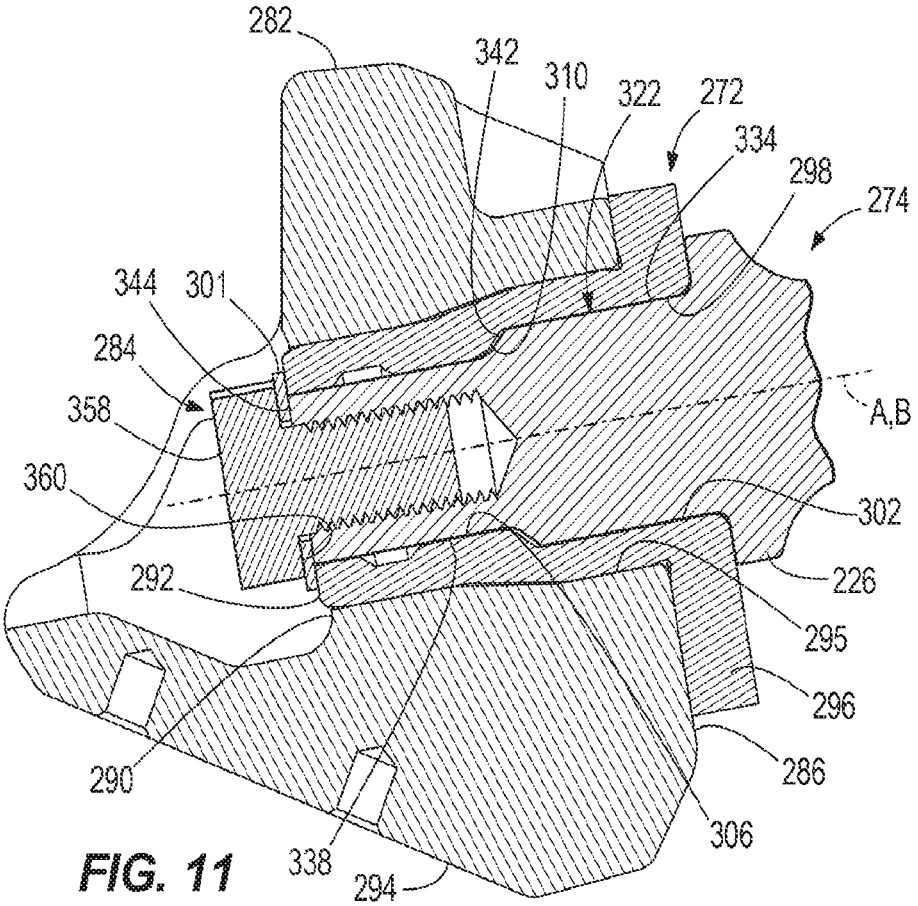
FIG. 11 is a section view of a portion of the cutting bit assembly of FIG. 10 viewed along 11-11.

Referring to FIGS. 9 and 11, the sleeve 272 is received in the bore of the holder block 282 and includes a rear surface 292, a forward shoulder 296, and a sleeve bore 298 extending between the rear surface 292 and the forward shoulder 296. The sleeve bore 298 defines a central axis A. The sleeve bore 298 includes a first portion 302 separated from a second portion 306 by a ledge 310. The forward shoulder 296 abuts the forward surface 286 of the holder block 282, whereas the rear surface 292 of the sleeve 272 is adjacent the rear surface 290 of the holder block 282. In the illustrated embodiment, the rear surface 292 of the sleeve 272 extends beyond the rear surface 290 of the holder block 282. In other embodiments, the rear surfaces 290, 292 may be substantially coextensive, or the rear surface 290 of the holder block 282 may extend beyond the rear surface 292 of the sleeve 272. The sleeve 272 is press-fit (e.g., interference fit) into the bore of the holder block 282 to inhibit rotation of the sleeve 272 relative to the holder block 282.

FIGS. 9 and 11 illustrate the bit 274 including a first portion 314, and a shank 322. The shank 322 extends between an end surface 344 of the bit 274 and the first portion 314. The shank 322 defines a bit axis B. The illustrated shank 322 includes a first portion 334, a second portion 338, and an external tapered portion 342. In the illustrated embodiment, the shank 322 includes an internal threaded bore 346 having a length 350 (FIG. 9).

The bit 274 includes a shoulder 226 and a flat surface (not shown) that are similar to the shoulder 126 and the flat surface 130 (FIG. 5). In addition, the sleeve 272 includes a projection or lip (not shown) similar to the lip 100 (FIG. 4). As such, the flat surface of the bit 274 engages the lip of the sleeve 272 to inhibit rotation therebetween.

The illustrated retainer 284 includes a threaded portion 354 and a hexagonal shaped head 358. The head 358 defines a retaining surface 360.

In addition, a washer 301 is received onto the threaded portion 354 and positioned between the retaining surface 360 and the end surface 344 of the bit 274. In particular, the washer 301 is configured to abut the retaining surface 360 of the retainer 284 and the rear surface 292 of the sleeve 272 (FIG. 11). In one embodiment, the washer 301 also abuts the end surface 344 of the bit 274.

As shown in FIG. 11, when the bit 274 is received within the sleeve bore 298, the external tapered portion 342 abuts the ledge 310 and the bit axis B is aligned with the central axis A of the sleeve bore 298. When the retainer 284 engages the internal threaded bore 346 of the bit 274, the retaining surface 360 abuts the washer 301, and in turn, the washer 301 abuts the rear surface 292 of the sleeve 272 and the end surface 344 of the bit 274. In other embodiments, the end surface 344 may be recessed from the rear surface 292 of the sleeve 272 such that the washer 301 only abuts the rear surface 292. In further embodiments, the washer 301 may be omitted such that the retaining surface 360 directly abuts the rear surface 292 of the sleeve 272 and/or the end surface 344 of the bit 274.

FIGS. 12-16 illustrate a cutting bit assembly 466 according to another embodiment. The cutting bit assembly 466 is similar to the cutting bit assembly 66; therefore, similar components have been given similar reference numbers, plus 400. Only differences between the cutting bit assemblies 66, 466 will be discussed in detail. In addition, components or features described with respect to only one or some of the embodiments described herein are equally applicable to any other embodiments described herein.

Figure 12:
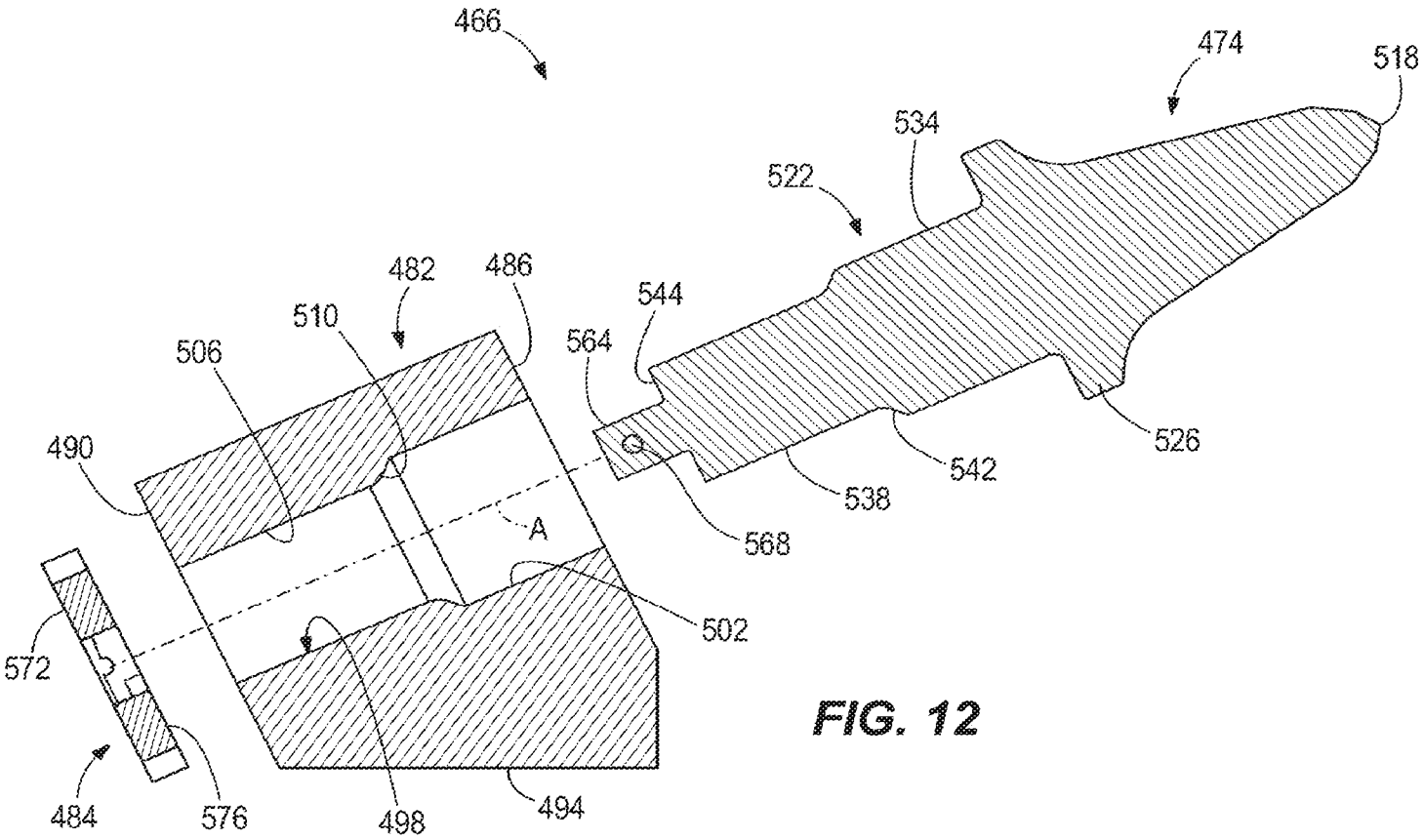
FIG. 12 is an exploded side section view of a cutting bit assembly according to another embodiment.
Figure 13:
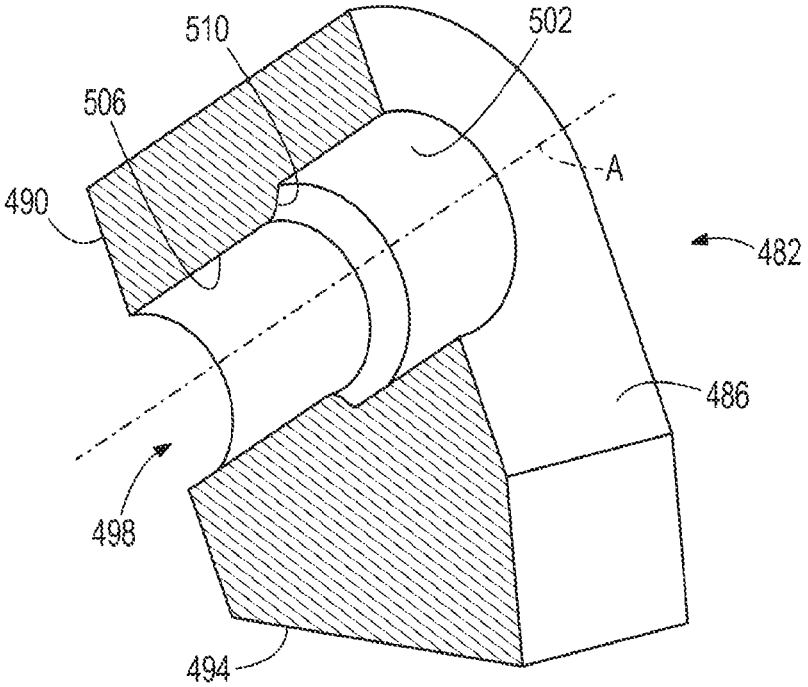
FIG. 13 is a perspective section view of a holder block of the cutting bit assembly of FIG. 12.

Referring to FIG. 12, the cutting bit assembly 466 includes a bit 474 and a holder block 482. The bit 474 is secured to a holder block 482 by a retainer 484. As shown in FIGS. 12 and 13, the holder block 482 defines a forward surface 486, a rear surface 490, a supporting surface 494, and a bore 498. In some embodiments, a projection or lip may be formed on the front surface 486 similar to the lip 100 of FIGS. 3 and 4. In the illustrated embodiment, the bore 498 defines a central axis A. The bore 498 includes a first portion 502, a second portion 506, and an internal tapered portion or ledge 510 positioned between the first portion 502 and the second portion 506.

Figure 14:
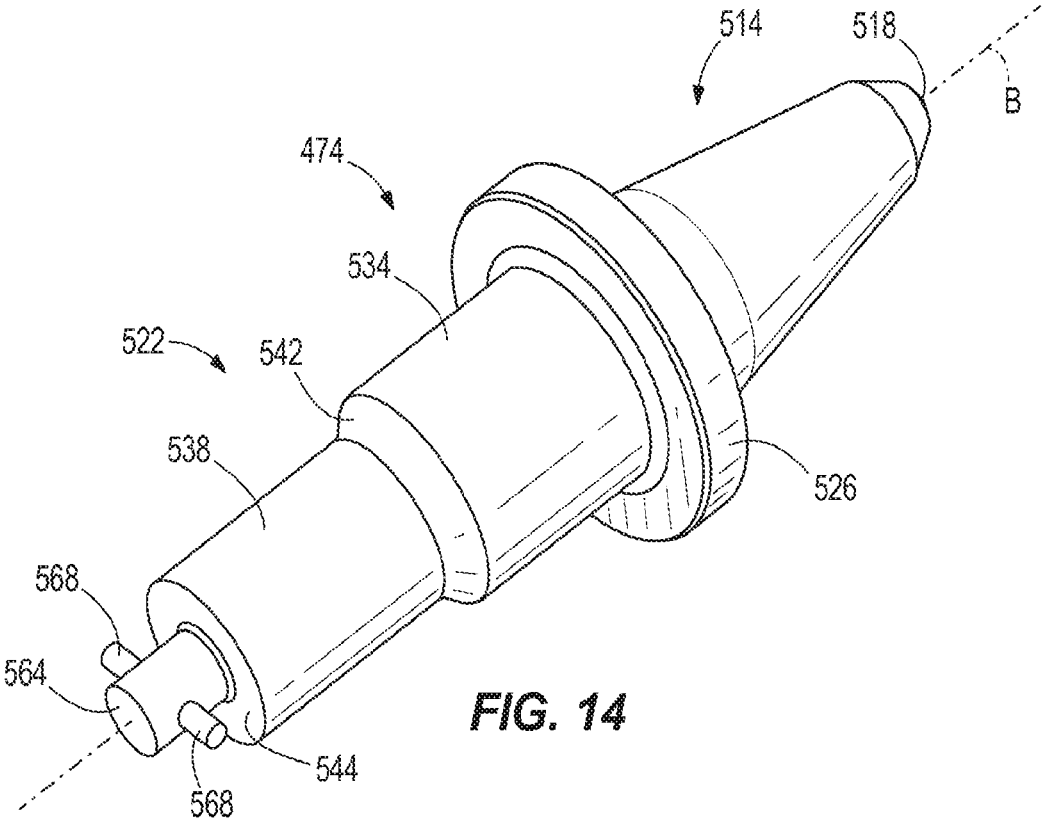
FIG. 14 is a perspective view of a bit of the cutting bit assembly of FIG. 12.

FIG. 14 illustrates the bit 474 including a first portion 514 having a tip 518 and a shank 522. Although the first portion 514 of the bit 474 in the illustrated embodiment has a tapered or conical shape, it is understood that the first portion 514 may have a different shape. The shank 522 is positioned proximate an end surface 544 of the bit 474, distal with respect to the tip 518. The shank 522 defines a bit axis B. The bit 474 further includes a shoulder 526. The illustrated shank 522 includes a first portion 534, a second portion 538, and an external tapered portion 542. The first portion 534, second portion 538 and external tapered portion 542 are sized to abut the first portion 502 of the bore 498, the second portion 506 of the bore 498, and the ledge 510, respectively.

In the illustrated embodiment, the shank 522 includes a finger 564 extending from the end surface 544 and away from the tip 518. In the illustrated embodiment, the finger 564 includes a smaller diameter than the rest of the shank 522. In other embodiments, the finger 564 may have the same diameter as the shank 522. The illustrated finger 564 includes projections 568 extending perpendicular to the central axis B of the bit 474. In the illustrated embodiment, the projections 568 are cylindrical rods extending from opposite sides of the finger 564. In other embodiments, the projections 568 may define a different geometry. In further embodiments, the projections 568 may be integrally or separately formed with the finger 564.

Figure 15:
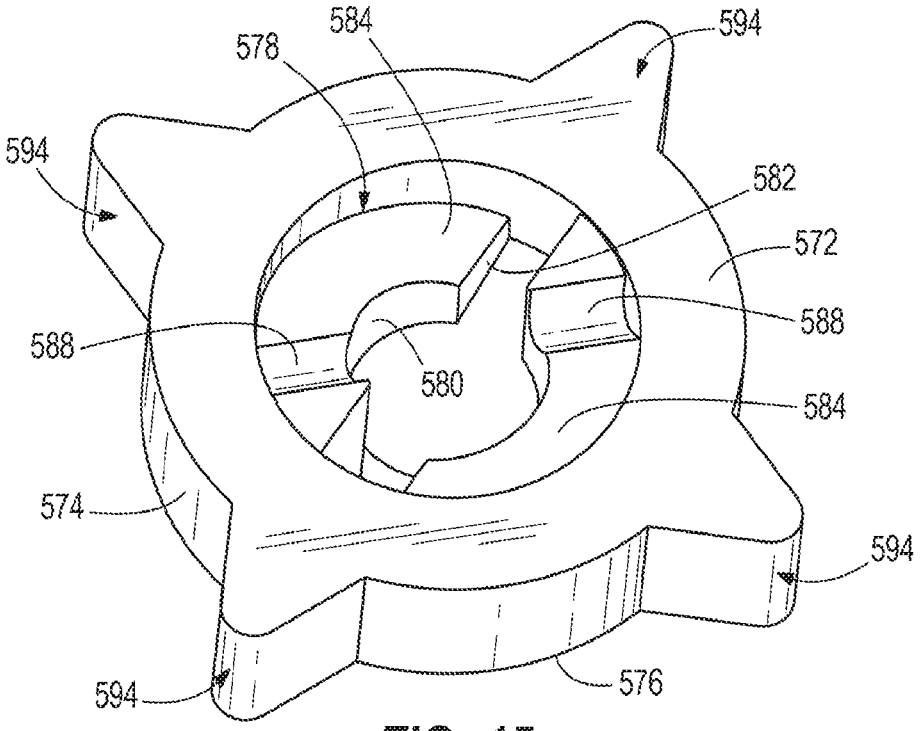
FIG. 15 is a perspective view of a retainer of the cutting bit assembly of FIG. 12.
Figure 16:
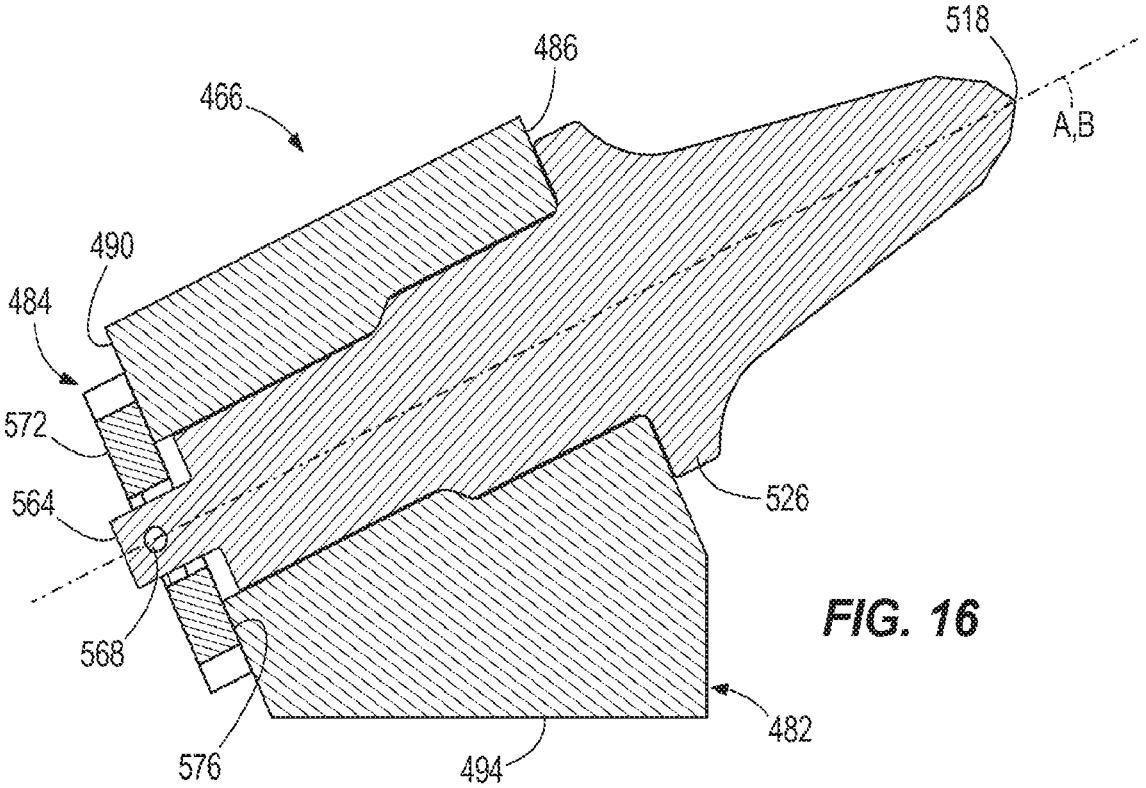
FIG. 16 is a side section view of the cutting bit assembly of FIG. 12 in an assembled state.

As shown in FIG. 15, the retainer 484 defines an annular shape including a first side 572, a second side 576 opposite the first side 572, an outer edge 574, and an inner opening 578. The first side 572 and the second side 576 extend radially between the outer edge 574 and the inner opening 578. The second side 576 is configured to face the end surface 544 of the bit 474 and/or the rear end surface 490 of the holder block 482 (FIG. 16). An aperture 580 is located within the inner opening 578, and the aperture 580 includes openings 582 for receiving the finger 564 and the projections 568 of the bit 474. In the illustrated embodiment, inclined or angled surfaces 584 extend around the inner opening 578 in a helical manner between the first side 572 and the second side 576. In addition, a groove 588 is located on each of the angled surfaces 584, and the grooves are spaced apart by 180 degrees with respect to each other. The grooves 588 are sized to engage the projections 568. In the illustrated embodiment, the retainer 484 is manufactured from a plastic material; however, in other embodiments, the retainer 484 may be manufactured from a metallic material.

Figure 20:
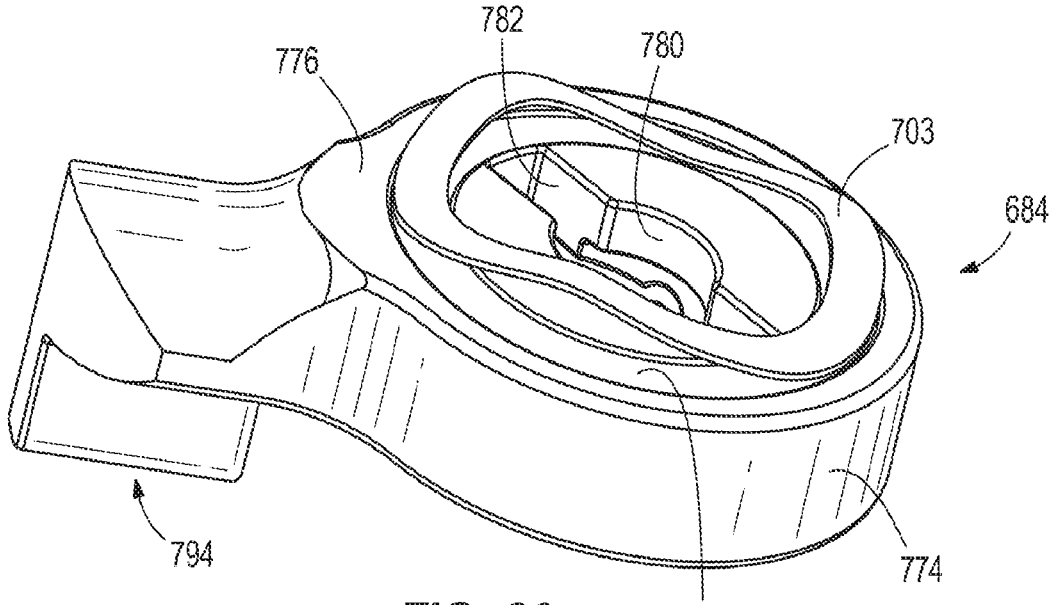
FIG. 20 is a perspective view of a second side of the retainer of FIG. 19.

In one embodiment, a resilient member (e.g., a wave spring washer as shown in FIG. 20) is coupled to the second side 576 and engages at least one of the rear surface 490 of the holder block 482 and the end surface 544 of the bit 474 to bias the retainer 484 away from the holder block 482. The resilient member may be a leaf spring, a Belleville washer, or a wave spring washer. Furthermore, in other embodiments the resilient member may be formed as an independent piece that is not directly attached to the holder block 482 or the retainer 484, or the resilient member may be formed integrally with the retainer 484 (e.g., by molding the resilient member into the retainer 484 or as a part of the retainer 484).

An outer circumference of the retainer 484 includes tabs 594 radially extending away from the aperture 580 and configured to be gripped to rotate the retainer 484. In the illustrated embodiment, the retainer 484 includes four equally spaced tabs (e.g., each positioned 90 degrees apart); however, in other embodiments, the retainer 484 may include more or less than four tabs.

To replace a damaged or worn bit 474 from the holder block 482, a replacement bit 474 is received in the bore 498 such that the finger 564 extends from the rear end surface 490. The retainer 484 is received onto the finger 564 by aligning the aperture 580 with the projections 568. Rotation of the retainer 484 (e.g., clockwise) with respect to the bit 474 about the axis B allows the projections 568 to engage and slide along the angled surfaces 584 from the second side 576 toward the second side 572. Sliding the projections 568 along the angled surfaces 584 in this manner causes the second side 576 to apply an axial tightening force against the bit 474 and/or the holder block 482. Rotation of the retainer 484 stops when the projections 568 are seated within the grooves 588, which provides a locked position in which the projections 568 are secured against rotation relative to the retainer 584. By rotating the retainer 484 less than 180 degrees about the axis B, the retainer 484 is fully locked onto the bit 474. In addition, the resilient member, which is positioned between the holder block 482 and the retainer 484, provides a biasing force to bias the retainer 484 away from the holder block 482. As a result, the projections 568 are inhibited from slipping out of the grooves 588.

To remove the retainer 484 out of engagement with the bit 474, the retainer 484 is rotated (e.g., counter clockwise) with sufficient force to displace the projections 568 from the grooves 588. The projections 568 slide downwardly along the angled surfaces 584 from the first surface 572 toward the second surface 576. Once the projections 568 align with the aperture 580, the retainer 484 can be removed from the bit 474.

FIGS. 17-22 illustrate a cutting bit assembly 666 according to another embodiment. The cutting bit assembly 666 is similar to the cutting bit assembly 466; therefore, similar components have been given similar reference numbers, plus 200. Only differences between the cutting bit assemblies 666 will be discussed in detail. In addition, components or features described with respect to only one or some of the embodiments described herein are equally applicable to any other embodiments described herein.

Figure 17:
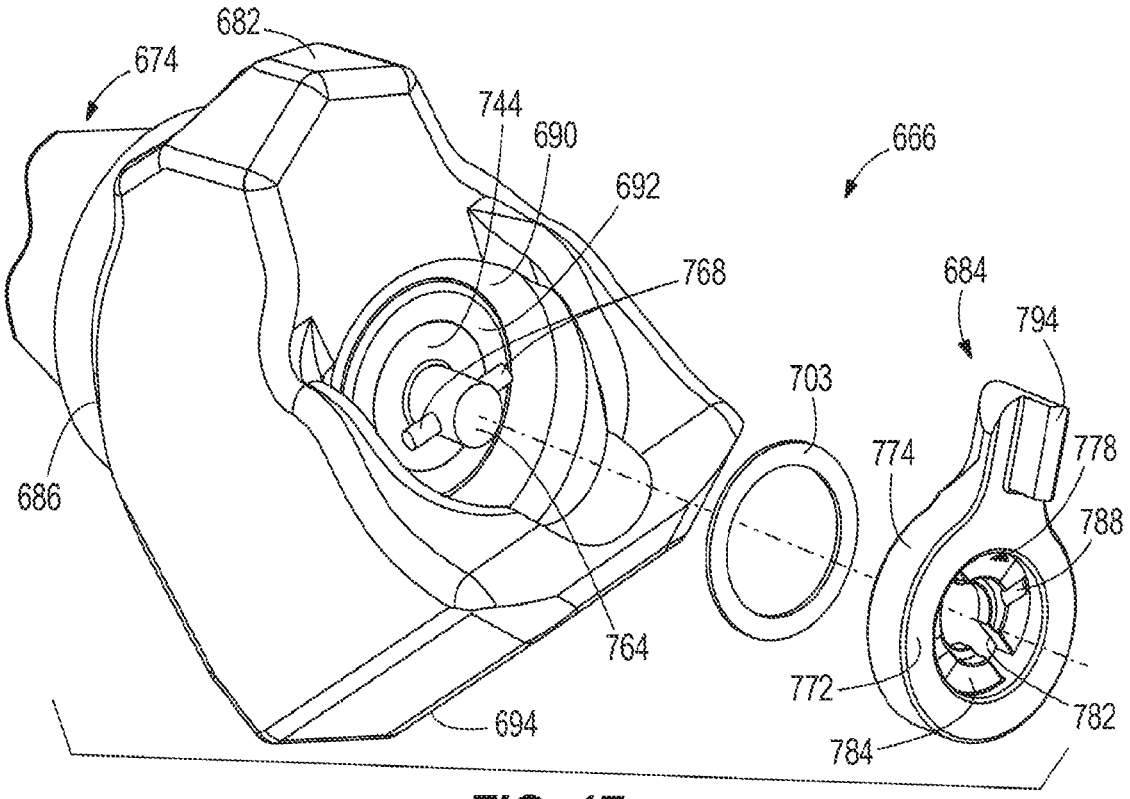
FIG. 17 is a partially exploded perspective view of a cutting bit assembly according to another embodiment.

Referring to FIG. 17, the cutting bit assembly 666 includes a bit 674, a sleeve 672 (FIG. 18), and a holder block 682. The illustrated sleeve 672 is similar to the sleeve 272 of the cutting bit assembly 266. The bit 674 is secured to a holder block 682 by a retainer 684.

Figure 18:
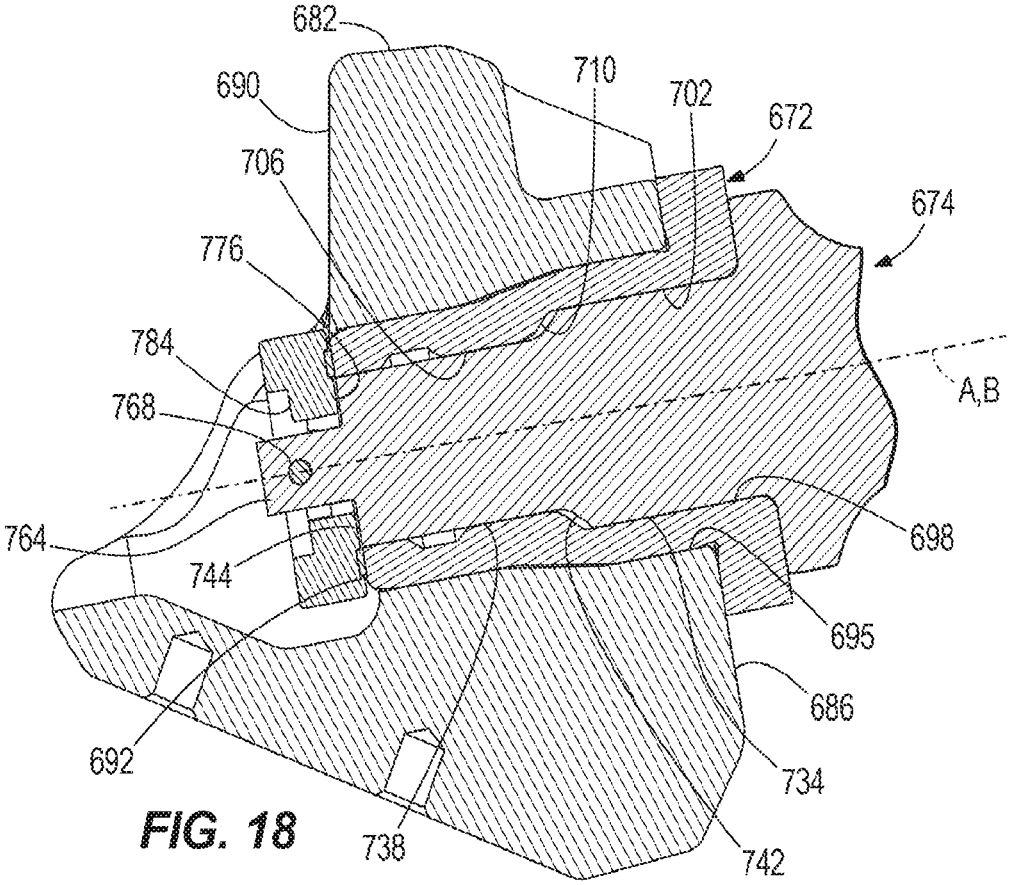
FIG. 18 is a section view of a portion of the cutting bit assembly from FIG. 22 viewed along section 18-18.

As shown in FIG. 18, the holder block 682 defines a first or forward surface 686, a second or rear surface 690, a supporting surface 694, and a bore 695. The sleeve 672 includes a rear surface 692, a forward shoulder 696, and a bore 698. The bore 698 defines a central axis A. In the illustrated embodiment, the axis A is aligned with a central axis defined by the bore 695 of the holder block 682. The bore 698 includes a first portion 702, a second portion 706, and a tapered surface or ledge 710.

FIG. 17 illustrates the bit 674 including a first portion 714 and a shank 722. The shank 722 extends between an end surface 744 of the bit 674 and the first portion 714. The shank 722 defines a bit axis B (FIG. 18). The illustrated shank 722 includes a first portion 734, a second portion 738, and an external tapered portion 742. In the illustrated embodiment, the shank 722 includes a finger 764 extending from the end surface 744. The illustrated finger 764 includes projections 768 extending perpendicular to the central axis B of the bit 674.

Although not shown, the bit 674 may include a shoulder and a flat surface similar to the shoulder 126 and the flat surface 130 described above with respect to FIG. 5. In addition, the sleeve 672 can include a projection or lip (not shown) that is similar to the lip 100 described above with respect to FIG. 4. As such, the flat surface of the bit 674 may engage the lip of the sleeve 672 to inhibit rotation between the bit 674 and the sleeve 672.

Figure 19:
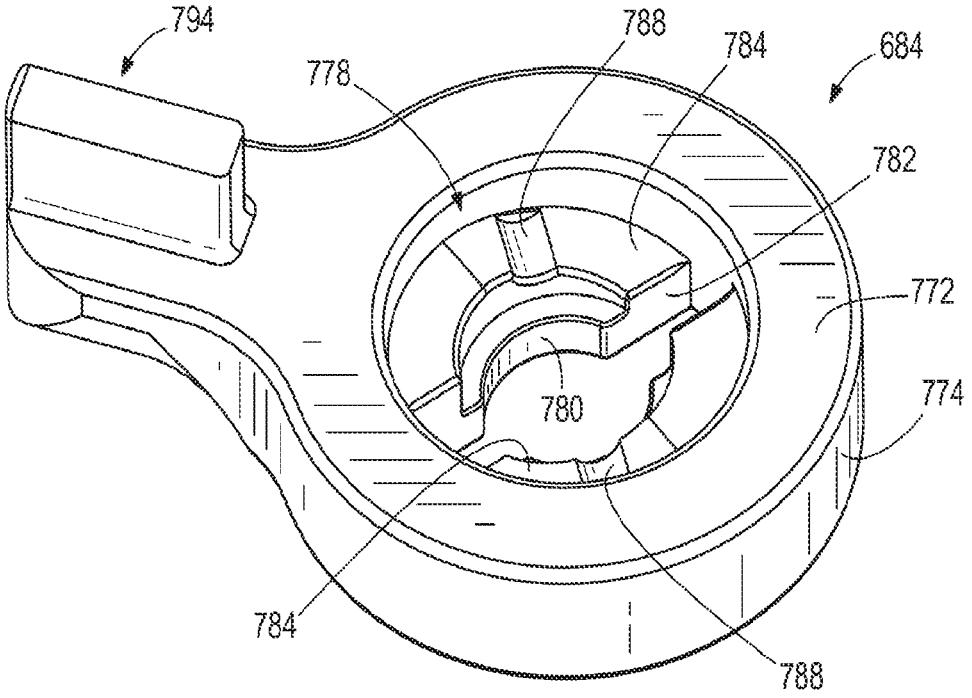
FIG. 19 is a perspective view of a first side of a retainer of the cutting bit assembly of FIG. 17.

Referring now to FIGS. 19 and 20, the retainer 684 defines an annular shape including a first side 772, a second side 776, an outer edge 774, and an inner opening 778. Inclined or angled surfaces 784 and an aperture 780 are located within the inner opening 778. In addition, a groove 788 is located on each of the angled surfaces 784. The function of these features is similar to the retainer 484 described above with respect to FIG. 15.

FIG. 20 illustrates a resilient member 703 coupled to the second side 776 of the retainer 684 and is seated within an annular groove 705 on the second side 776. The illustrated resilient member 703 engages the rear surface 692 of the sleeve 672 to bias the retainer 684 away from the sleeve 672 (FIG. 18). In other embodiments, the resilient member 703 may engage the rear surface 692 of the sleeve 672, the end surface 744 of the bit 674, and/or the rear surface 690 of the holder block 682. In the illustrated embodiment, the resilient member is a wave spring washer. In other embodiments, the resilient member may be a Belleville washer or a leaf spring. Furthermore, in other embodiments the resilient member 703 may be directly attached to the retainer 684, or the resilient member 703 may be formed integrally with the retainer 684 (e.g., by molding the resilient member into the retainer 684 or as a part of the retainer 684).

An outer circumference of the retainer 684 includes a lever or tab 794 configured to be gripped to rotate the retainer 684. In the illustrated embodiment, the tab 794 includes a portion that extends perpendicular from the first side 772 of the retainer 684.

Figure 22:
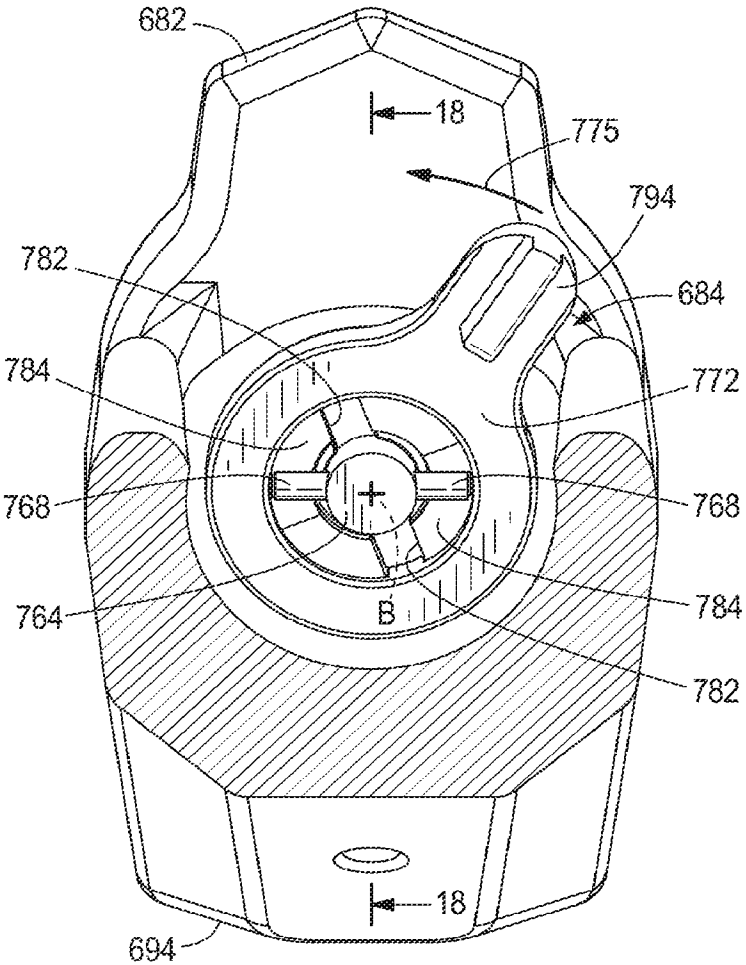
FIG. 22 is a rear view of the cutting bit assembly of FIG. 17 with the retainer in a locked position.
Figure 21:
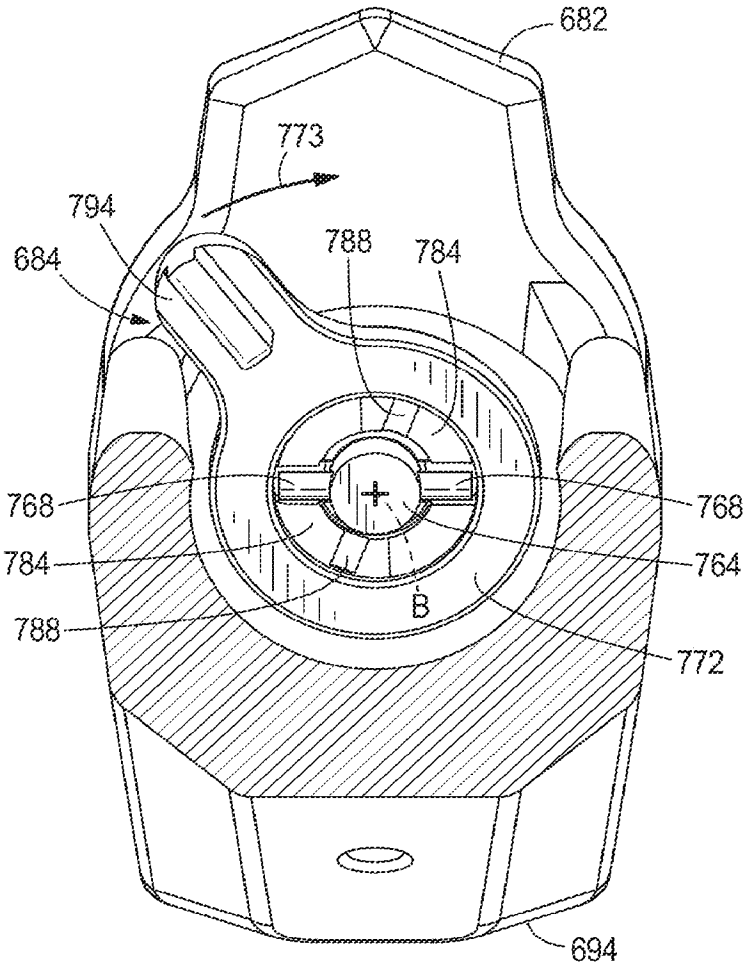
FIG. 21 is a rear view of the cutting bit assembly of FIG. 17 with the retainer in an unlocked position.

To secure a bit 674 within the holder block 682, a bit 674 is received in the bore 698 such that the finger 764 extends from the rear surface 692 of the sleeve 672. The retainer 684 is received onto the finger 764 by aligning the openings 782 of the aperture 780 with the projections 768 (FIG. 21). The retainer 684 is then rotated in a first direction 773 (e.g., clockwise in FIG. 21) relative to the bit 674 about the axis B. The projections 768 engage and slide along the angled surfaces 784 until the projections 768 are seated within the grooves 788 (i.e., a locked position). The resilient member 703 provides a biasing force to bias the retainer 684 away from the sleeve 672. As a result, the projections 768 are inhibited from slipping out of the grooves 788. FIG. 22 illustrates the retainer 684 in a locked position.

To remove the retainer 684 out of engagement with the bit 674, the retainer 684 is rotated in a second direction 775 about the axis B (e.g., counter clockwise in FIG. 22) with sufficient force to displace the projections 768 from the grooves 788. The projections 768 slide along the angled surfaces 784 until the projections 768 are aligned with the aperture 780. The retainer 684 is then removed from the bit 674. FIG. 21 illustrates the retainer 684 in an unlocked position.

Although the cutting bit assemblies have been described above with respect to a continuous mining machine, it is understood that the cutting bit assemblies could be incorporated onto various types of cutter heads and various types of mining machines.

Although some aspects have been described in detail with reference to certain preferred embodiments, variations and modifications exist within the scope and spirit of one or more independent aspects as described.

What is claimed is:

1. A cutting bit assembly for a mining machine, the cutting bit assembly comprising:

a holder including a first surface, a second surface, and a bore extending therebetween;

a bit including a first end and a second end, the bit further including a tip proximate the first end, a shank proximate the second end, and a shoulder positioned between the tip and the shank, the shank positioned in the bore of the holder, the shank defining a shank axis, the shoulder positioned proximate the first surface of the holder, the shank including a projection adjacent the second end, the projection extending substantially perpendicular to the shank axis; and a retainer coupled to the shank by passing the retainer over the projection along the shank axis, the retainer including an aperture sized to receive the projection, the retainer having an annular shape and including a groove, an outer edge, an inner opening, and an angled surface, the angled surface positioned within the inner opening, the angled surface extending along an angular portion around the inner opening, the angled surface extending between the groove and the aperture, as the retainer is rotated relative to the bit the projection moves along the angled surface and slides into the groove, the retainer further including a resilient member positioned proximate the second surface of the holder and biasing the retainer along the shank axis and away from the holder, the resilient member biasing the projection to remain within the groove.

2. The cutting bit assembly of claim 1, wherein rotation of the retainer in a first direction less than 180 degrees about the shank axis secures the retainer to the bit, and wherein rotation of the retainer in a second direction opposite from the first direction unlocks the retainer from the bit.

3. The cutting bit assembly of claim 1, wherein the retainer is made from a plastic material.

4. The cutting bit assembly of claim 1, wherein the retainer includes a plurality of tabs extending out from the outer edge and are configured to be gripped during rotation of the retainer.

5. The cutting bit assembly of claim 1, wherein the retainer includes a first side positioned adjacent the second surface of the holder, wherein the resilient member is a wave spring coupled to the first side of the retainer.

6. The cutting bit assembly of claim 1, wherein at least a portion of the shank includes an external taper, and wherein at least a portion of the bore of the holder includes an internal taper that abuts the external taper formed on the shank of the bit when the bit is received within the holder.

7. The cutting bit assembly of claim 6, wherein when the internal taper of the bore abuts the external taper of the shank, the second end of the bit does not extend beyond the rear surface of the holder.

8. The cutting bit assembly of claim 1, wherein the first surface of the holder includes a stop surface protruding from the first surface.

9. The cutting bit assembly of claim 8, wherein the shoulder includes a flat surface engaging the stop surface to inhibit rotational movement of the bit relative to the holder.

10. The cutting bit assembly of claim 1, further comprising a sleeve positioned in the bore of the holder, wherein the shank is positioned in the bore of the sleeve such that the sleeve is between the shank and the holder bore, the shoulder engaging the sleeve, wherein the resilient member engages an end surface of the sleeve.

11. The cutting bit assembly of claim 1, wherein the retainer is positioned between the projection and the second surface of the holder.

12. A cutting bit assembly for a mining machine, the cutting bit assembly comprising:

a holder including a first surface, a second surface, and a bore extending therebetween;

a bit including a first end and a second end, the bit further including a tip proximate the first end, a shank proximate the second end, and a shoulder positioned between the tip and the shank, the shank positioned in the bore of the holder, the shank defining a shank axis, the shoulder positioned proximate the first surface of the holder, the shank including a projection adjacent the second end;

a retainer including a groove, an opening, and an inclined surface extending between the groove and the opening and extending in a helical manner around a portion of the retainer, rotation of the retainer relative to the bit causing the projection to slide along the inclined surface until the projection engages the groove; and a resilient member positioned proximate the second surface of the holder and biasing the retainer along the shank axis and away from the holder.

13. The cutting bit assembly of claim 12, wherein rotation of the retainer in a first direction less than 180 degrees about the shank axis secures the retainer to the bit, and wherein rotation of the retainer in a second direction opposite from the first direction unlocks the retainer from the bit.

14. The cutting bit assembly of claim 12, wherein the projection extends substantially perpendicular to the shank axis.

15. The cutting bit assembly of claim 12, wherein the retainer is coupled to the shank by passing the retainer over the projection along the shank axis, the retainer including an aperture sized to receive the shank and the projection.

16. The cutting bit assembly of claim 12, wherein the retainer has an annular shape and includes an outer edge and an inner opening, the inclined surface positioned within the inner opening, the resilient member biasing the projection to remain within the groove while the projection is positioned within the groove.

17. The cutting bit assembly of claim 12, wherein the retainer is made from a plastic material.

18. The cutting bit assembly of claim 12, wherein the retainer includes at least one engagement member protruding from an outer edge and configured to be gripped during rotation of the retainer.

19. The cutting bit assembly of claim 12, wherein the retainer includes a first side positioned adjacent the second surface of the holder, wherein the resilient member is a wave spring coupled to the first side of the retainer.

20. The cutting bit assembly of claim 12, wherein at least a portion of the shank includes an external taper, and wherein at least a portion of the bore of the holder includes an internal taper that abuts the external taper formed on the shank of the bit when the bit is received within the holder.

21. The cutting bit assembly of claim 20, wherein when the internal taper of the bore abuts the external taper of the shank, the second end of the bit does not extend beyond the rear surface of the holder.

22. The cutting bit assembly of claim 12, wherein the first surface of the holder includes a stop surface protruding from the first surface, wherein the shoulder includes a surface engaging the stop surface to inhibit rotational movement of the bit relative to the holder.

23. The cutting bit assembly of claim 12, further comprising a sleeve positioned in the bore of the holder, wherein the shank is positioned in the bore of the sleeve such that the sleeve is between the shank and the holder bore, the shoulder engaging the sleeve, wherein the resilient member engages an end surface of the sleeve.

24. The cutting bit assembly of claim 12, wherein the retainer is positioned between the projection and the second surface of the holder.

25. The cutting bit assembly of claim 12, wherein the projection is a first projection and the shank further includes a second projection, wherein the groove is a first groove, the opening if a first opening, and the inclined surface is a first inclined surface, the retainer further including a second groove, a second opening, and a second inclined surface extending between the second groove and the second opening and extending in a helical manner around the retainer, rotation of the retainer relative to the bit causing the second projection to slide along the second inclined surface until the second projection engages the second groove.

* * * * *